United States Patent [19]

Fisher et al.

[11] 4,372,184

[45] Feb. 8, 1983

[54] CUTTING ASSEMBLY

[75] Inventors: Wayland I. Fisher, Boise; Marvin J. Petersen, Homedale, both of Id.

[73] Assignee: J. R. Simplot Company, Boise, Id.

[21] Appl. No.: 238,007

[22] Filed: Feb. 25, 1981

[51] Int. Cl.[3] ..... B26D 1/03

[52] U.S. Cl. ..... 83/98; 83/102; 83/164; 83/402; 83/404.3; 83/857; 99/543; 99/545

[58] Field of Search ..... 83/102, 105.98, 164, 83/402, 404.3, 404.1, 856–858; 99/543, 545

[56] References Cited

U.S. PATENT DOCUMENTS

| | | | |
|---|---|---|---|
| 193,959 | 8/1877 | Howard | 99/545 |
| 2,092,763 | 9/1937 | LeFrank | 99/545 X |
| 2,097,170 | 10/1937 | Wilson | 99/543 |
| 2,437,637 | 3/1948 | Bridge | 99/545 |
| 3,108,625 | 10/1963 | Lamb et al. . | |
| 3,109,468 | 11/1963 | Lamb et al. . | |
| 3,116,772 | 1/1964 | Lamb et al. . | |
| 3,494,398 | 2/1970 | Farmer | 99/545 X |
| 4,082,024 | 4/1978 | Hodges et al. . | |
| 4,135,002 | 1/1979 | Hodges et al. . | |

FOREIGN PATENT DOCUMENTS

| | | | |
|---|---|---|---|
| 740217 | 6/1980 | U.S.S.R. | 99/543 |

*Primary Examiner*—Frank T. Yost

*Attorney, Agent, or Firm*—Fulwider, Patton, Rieber, Lee & Utecht

[57] ABSTRACT

A cutting assembly is provided for use in cutting vegetable products, such as potatoes and the like, into a longitudinally extending central core and a plurality of longitudinally extending outer strips having a generally arcuate cross section. The cutting assembly is mounted along an hydraulic flow path defined by an inlet pressure conduit for passage of the product one at a time at a relatively high velocity into cutting engagement with a core knife and a plurality of strip knives and for separation of the core and the outer strips for respective flow along an inner core discharge conduit and a concentric outer strip discharge conduit. The cutting assembly is supported within an assembly housing between the inlet conduit and the discharge conduits with the core knife having a cylindrical shape for mounting at the upstream end of the core discharge conduit and defining a circular leading cutting edge along the axis of the flow path. The plurality of strip knives are angularly arranged between the core knife and the assembly housing to extend radially therebetween for supporting the core knife in position and to define radially extending leading cutting edges for engaging the product. The core knife and the strip knives cooperate with the housing to define flow paths through the cutting assembly of substantially constant cross section for passage of the appropriate product pieces without substantial reduction in the hydraulic pressure applied thereto.

22 Claims, 6 Drawing Figures

CUTTING ASSEMBLY

BACKGROUND OF THE INVENTION

This invention relates to a cutting assembly for cutting vegetable products, such as potatoes and the like. More specifically, this invention relates to an improved cutting assembly particularly designed for cutting a potato into a generally cylindrical central core and a plurality of outer strips each having a generally arcuate cross section.

Cutting devices in general for use in cutting vegetable products, such as potatoes and the like, are well known in the art. These cutting devices include various mechanisms for moving the potato into cooperation with one or more knife elements to sever the potato into a plurality of longitudinal strips, cross sectional slices, and the like of desired size and shape. For example, cutting devices are known for cutting potatoes into relatively thin slices for frying or into a plurality of lengthwise strips to form so-called French fries. However, prior art cutting devices in general for cutting potatoes have been characterized by a relatively slow production rate, thereby requiring a relatively large number of the cutting devices when high production rates are desired.

In an attempt to improve potato cutting production rates, so-called hydraulic cutting assemblies have been developed wherein potatoes are propelled one at a time through a conduit with an hydraulic fluid such as water at a relatively high velocity to impact a plurality of cutting knives secured by appropriate support members to extend transversely across the hydraulic flow path. The kinetic energy applied to each potato by the hydraulic fluid is sufficient to drive the potato past the cutting knives whereby the potato is cut into a plurality of pieces. See, for example, U.S. Pat. Nos. 3,108,625; 3,109,468; and 3,116,722. Typically, these hydraulic cutting assemblies have included a crisscross rectangular array of the cutting knives to divide the potato into French fry strips each having a rectangular cross section. In order to assure uniform high quality of size and shape, and relatively uniform cellular composition of the French fry strips, it is common to form the cutting knife array to have a size smaller than the cross section of the potatoes whereby flat-shaped outer slabs are removed from each potato resulting in a core of square cross section for cutting into the French fry strips.

The flat-shaped outer slabs and the French fry strips are separated for flow into individual, concentric discharge conduits, as suggested in said U.S. Pat. Nos. 3,108,625; 3,109,468; and 3,116,722. The strips are normally subjected to further processes such as parfrying, freezing, and the like, whereas the outer slabs are sometimes used in the production of other types of potato products such as flakes or granules, provided that the potatoes have been peeled prior to engagement with the cutting knives. Alternately, it is not uncommon for the outer slabs to be discarded as waste.

In prior art hydraulic cutting assemblies, the cutting assembly including the plurality of knives and the associated support members occupies a volume substantially larger than the volume of a corresponding length of the hydraulic conduit. As a result, the hydraulic fluid entering the cutting assembly substantially and rapidly drops in pressure to create a high degree of fluid turbulence within the cutting assembly. While the French fry strips cut from the square core normally have sufficient structural integrity to withstand this turbulence, the relatively thin and fragile outer slabs experience a high incidence of fracturing or shattering to render these slabs unusable as a separate slab-shaped potato product. Moreover, the substantial hydraulic pressure drop fails to optimize the hydraulic driving force acting upon the potatoes across the cutting assembly, resulting in a less than optimum production rate or requiring excessive pumping pressures to achieve a desired production rate.

Recently, it has been proposed to utilize an outer slab-type portion of the potato as a separate potato product. More specifically, a generally slab-shaped potato product having particular consumer appeal as an hors d'oeuvre has been proposed comprising a longitudinal strip cut from the outer portion of a potato to include a generally shell-shaped or arcuate cross section with exterior peel intact. See, for example. U.S. Design Patent Application Ser. No. 224,309, filed Jan. 12, 1981. This slab-type product cannot, however, be formed at a relatively high production rate by use of prior art hydraulic cutting assemblies without unacceptable incidence of product breakage as a result of hydraulic fluid turbulence.

Accordingly, there is a need for an improved hydraulic cutting assembly designed to sever a vegetable product such as a potato into an inner core and a plurality of outer strips or slabs wherein the shape integrity of the outer strips is maintained. The present invention fulfills this need by providing an hydraulic cutting assembly wherein various knife elements in the assembly are defined by interconnected structural support members having appropriate cutting edges formed thereon to provide a structurally rigid and optimally compact cutting assembly allowing volumetric control of hydraulic flow paths through the assembly for corresponding control of fluid pressure reduction and turbulence.

SUMMARY OF THE INVENTION

In accordance with the present invention, a cutting assembly is provided for mounting along an hydraulic flow path through which a vegetable product, such as a potato, is propelled one at a time into cutting engagement with the assembly. The cutting assembly includes a plurality of strip knives rigidly secured between a cylindrical central core knife and an exterior assembly housing for cutting the potato into a generally cylindrical central core and a plurality of longitudinally extending outer strips each having a generally shell-shaped or arcuate cross section. The assembly housing, strip knives, and core knife cooperate with each other to define flow paths of relatively constant cross sectional area for each outer strip and for the core throughout the length of the cutting assembly, whereby the driving pressure of the hydraulic fluid acting upon the outer strips and the central core is not relieved within the cutting assembly to avoid fluid turbulence. The outer strips and the central core are guided from the cutting assembly into separate, concentric discharge conduits for subsequent processing. Conveniently, a crisscross array of cutting knives can be mounted at the downstream end of the core knife to divide the central core into French fry strips prior to entry into the associated discharge conduit.

In accordance with a preferred form of the invention, the cylindrical core knife is mounted at the upstream end of the core discharge conduit and projects forwardly therefrom terminating in a forwardly presented circular cutting edge coaxial with the central axis of the discharge conduit for cutting engagement with each potato in sequence. The diameter of the circular cutting edge is less than the average or nominal diameter of the potatoes, so that the core knife divides the potato into the longitudinal, cylindrical central core which passes into the interior of the core knife and a hollow outer portion which passes over the exterior of the core knife. The interior, or inner diameter, of the core knife defines an hydraulic flow path of substantially constant cross section so that the hydraulic driving force acting on the core is maintained throughout passage thereof through the core knife.

The exterior or outer diameter of the core knife is inclined or ramped in a radially outward direction from the axis of the core knife to cause the outer portion of the potato to be stripped progressively in a direction radially away from the core. The outer portion is divided longitudinally by a plurality of strip knives extending radially between the core knife and the assembly housing to form the plurality of outer strips. These outer strips are each defined by an arcuate inner surface according to the diameter of the core knife, radial side surfaces formed by an adjacent pair of strip knives, and an uncut outer surface preferably with peel intact.

The strip knives are anchored at their radially outer and inner edges within aligned slots formed respectively in the assembly housing and in the exterior of the core knife. With this construction, the strip knives provide cutting elements in addition to structurally supporting the core knife with respect to the core discharge conduit. In turn, the external assembly housing and the core knife cooperate to structurally support the strip knives. Importantly, the inner diameter surface of the assembly housing is tapered radially in a direction corresponding with the exterior of the core knife to provide hydraulic flow paths for the outer strips of substantially constant cross section so that the hydraulic driving force acting on the strips is maintained throughout passage through the cutting assembly. The outer strips exiting the cutting assembly are guided into the outer strip discharge conduit.

According to one form of the invention, a pair of knife collars are stacked in axial series between the downstream end of the core knife and the upstream end of the core discharge tube. Each of the collars supports a plurality of spaced parallel cutting knives disposed perpendicular to the knives of the other collar. The two collars thus together support a crisscross array of cutting knives for dividing the core into French fry strips which are discharged directly in the core discharge tube.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 6:
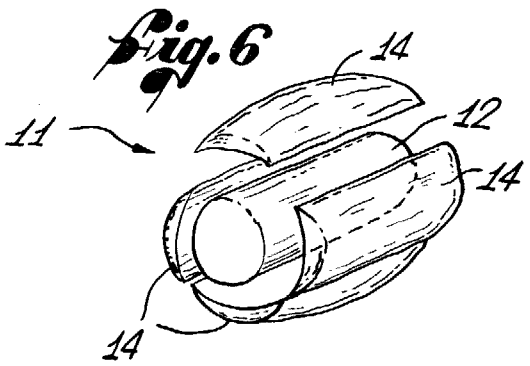
FIG. 6 is an exploded perspective view illustrating the relative shapes of a central core and outer strips of a potato cut by the cutting assembly of this invention.
Figure 3:
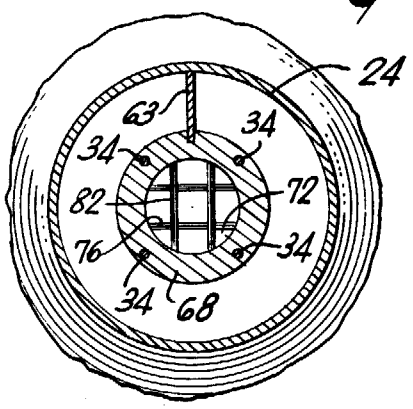
FIG. 3 is a fragmented vertical section taken generally on the line 3—3 of FIG. 2.
Figure 1:
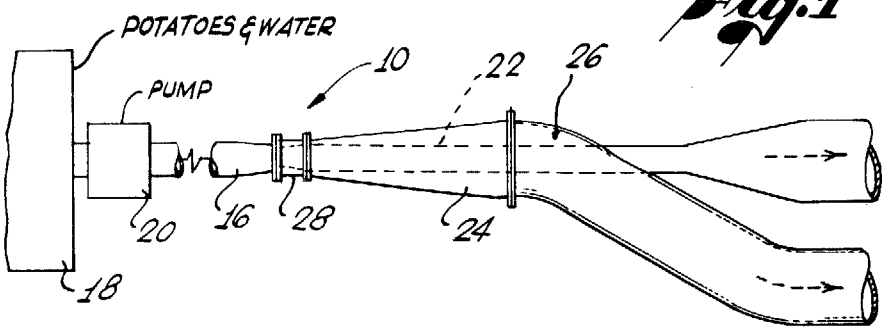
FIG. 1 is a fragmented elevation view, shown partially in schematic form, illustrating a typical hydraulic installation including a cutting assembly incorporating the novel features of this invention.

As illustrated generally in FIG. 1, a cutting assembly 10 incorporating the novel features of this invention is provided for installation along an hydraulic flow path through which a vegetable product, such as a potato, is propelled. The product impacts knife elements forming a part of the cutting assembly 10 which divide the product into a generally cylindrical central core 12 and a plurality of longitudinally extending outer strips 14 (FIG. 6) each having a generally shell-shaped or arcuate cross section.

Figure 2:
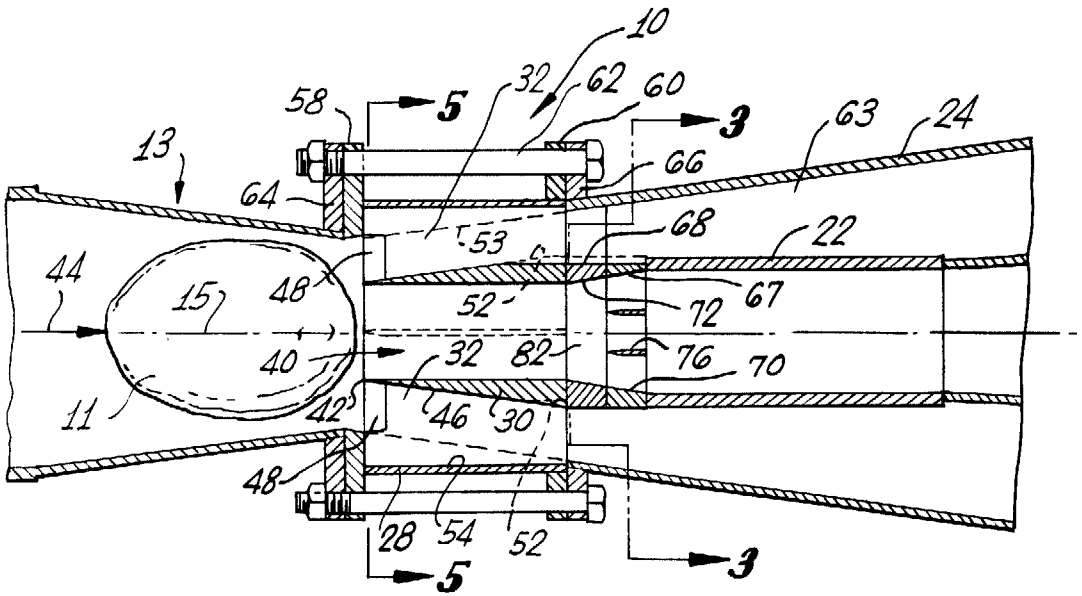
FIG. 2 is an enlarged, fragmented, lonngitudinal section illustrating the cutting assembly for cutting a potato.

The cutting assembly 10 of this invention is designed for use in conjunction with a conventional hydraulic pumping arrangement for pumping potatoes one at a time at a relatively high velocity along a pressure conduit 16 into cutting engagement with the knife elements of the cutting assembly. More specifically, the potatoes are pumped with an hydraulic fluid such as water from a reservoir 18 by a pump 20 for relatively high velocity flow through the pressure conduit 16. The pressure conduit 16 is coupled at its downstream end to the cutting assembly 10, with the kinetic energy imparted to each potato 11 being sufficient to propel the potato 11 into cutting engagement with and further through the knife elements of the assembly to divide the potato into two different types of pieces. If desired, the downstream end of the pressure conduit 16 can taper to a smaller cross section, as illustrated in FIG. 2 by arrow 13, to closely align each potato 11 with a central longitudinal axis 15 of the hydraulic flow path. Conveniently, this general arrangement is shown in schematic form in FIG. 1, with a more complete description of an exemplary arrangement being found in U.S. Pat. No. 3,109,468.

The two different types of potato pieces, which will be described herein in more detail, are separately discharged from the cutting assembly 10 for respective flow into and through two different conduits 22 and 24. The conduit 22 comprises a core discharge conduit disposed coaxially along the flow axis 15 for receiving one type of potato piece, and the other conduit 24 comprises an outer strip discharge conduit disposed concentrically about the core discharge conduit 22. As illustrated in FIG. 1, at a location downstream of the cutting assembly 10, the outer strip discharge conduit 24 is angularly offset from the core discharge conduit 22, and the core discharge conduit 22 extends outwardly through one wall of the outer strip discharge conduit 24. The two conduits 22 and 24 may then be associated in a suitable manner with equipment (not shown) for subsequent and separate processing of the two types of potato pieces. If desired, appropriate baffling (also not shown) can be provided near the intersection of the two conduits to prevent entrapment of potato pieces in small areas such as that illustrated by arrow 26 between the conduits, all in a well-known manner.

According to the invention, the cutting assembly 10 includes an arrangement of interfitting knife elements formed from a suitable knife steel or the like, wherein those elements perform the desired function of providing cutting edges for severing the potato and for structurally supporting each other between the upstream end of the core discharge conduit 22 and an external assembly housing 28 mounted between the pressure conduit 16 and the outer strip discharge conduit 24. The knife elements include a cylindrical hollow core knife 30 for cutting the potato to form the central core 12 and a plurality of radially extending strip knives 32 which cooperate with the core knife 30 to cut the outer strips 14, as shown in perspective view in FIG. 6. These outer strips 14 have been found to provide a consumer product of particular attractiveness for use, for example, as an hors d'oeuvre, while the central core 12 is readily converted into other products such as French Fries, potato slices, or the like. Importantly, the core knife 30 and the strip knives 32 are interconnected in a manner to provide flow passages for the core 12 and the strips 14 of substantially constant cross-sectional area so that the hydraulic driving force acting upon the potato pieces is not relieved until the individual pieces are discharged to the respective discharge conduits 22 and 24. This effectively drives the various pieces through the cutting assembly to make more efficient usage of the hydraulic driving force, and avoids substantial hydraulic turbulence which would otherwise act upon the outer strips to result in a high incidence of breakage of those strips.

As shown best in FIGS. 2-5, the core knife 30 is generally cylindrical in shape and is mounted at the upstream end of the core discharge conduit 22 in a position coaxial with the conduit 22. Positioning pins 34 are received in a pressfit relation into aligned holes 36 and 38 respectively formed in the upstream end of the conduit 22 and the downstream end of the core knife 30. The core knife 30 extends forwardly from the core discharge conduit to define a central longitudinal passage 40 of substantially constant cross-sectional area, and the upstream end of the core knife terminates in a circular knife or cutting edge 42.

When the potato 11 is propelled by the hydraulic fluid into engagement with the cutting assembly 10, in the direction of arrow 44 in FIG. 2, the cutting edge 42 of the core knife 30 separates the potato into the central core 14 (not shown in FIG. 2) which passes axially through the core knife passage 40, and a hollow outer portion which passes over the exterior or outer diameter 46 of the core knife. Importantly, this exterior of the core knife 30 has a generally cone-shaped or ramped configuration to displace the outer portion away from the core 12 progressively in a radially outward direction. During this movement, this outer portion is longitudinally divided to form the outer strips 14.

The constant cross-sectional area of the core knife passage 40 serves to maintain the hydraulic driving force acting upon the core 12 throughout the axial length of the core knife 30, and thus throughout the core cutting process for each potato 11. This hydraulic driving force is not relieved until the core 12 exits from the downstream end of the core knife 30 for entry into the core discharge conduit 22. With this arrangement, the hydraulic driving force is used in the most efficient manner throughout the core cutting process thereby allowing the use of a pump 20 for producing substantially less hydraulic pressure than is otherwise required in prior art hydraulic cutting assemblies.

The strip knives 32 are mounted between the core knife 30 and the exterior assembly housing 28 in an equiangular arrangement with each strip knife 32 extending radially with respect to the longitudinal axis of the core knife. The strip knives 32 are each generally rectangular in shape to have a length generally corresponding with the length of the core knife 30 and a width sufficient for appropriate coupling between the core knife and the assembly housing 28, as will be described. The core knives each include a cutting edge 48 at its upstream end for longitudinally dividing the outer portion of the potato into the plurality of the shell-shaped outer strips 14.

Figures 4, 5:
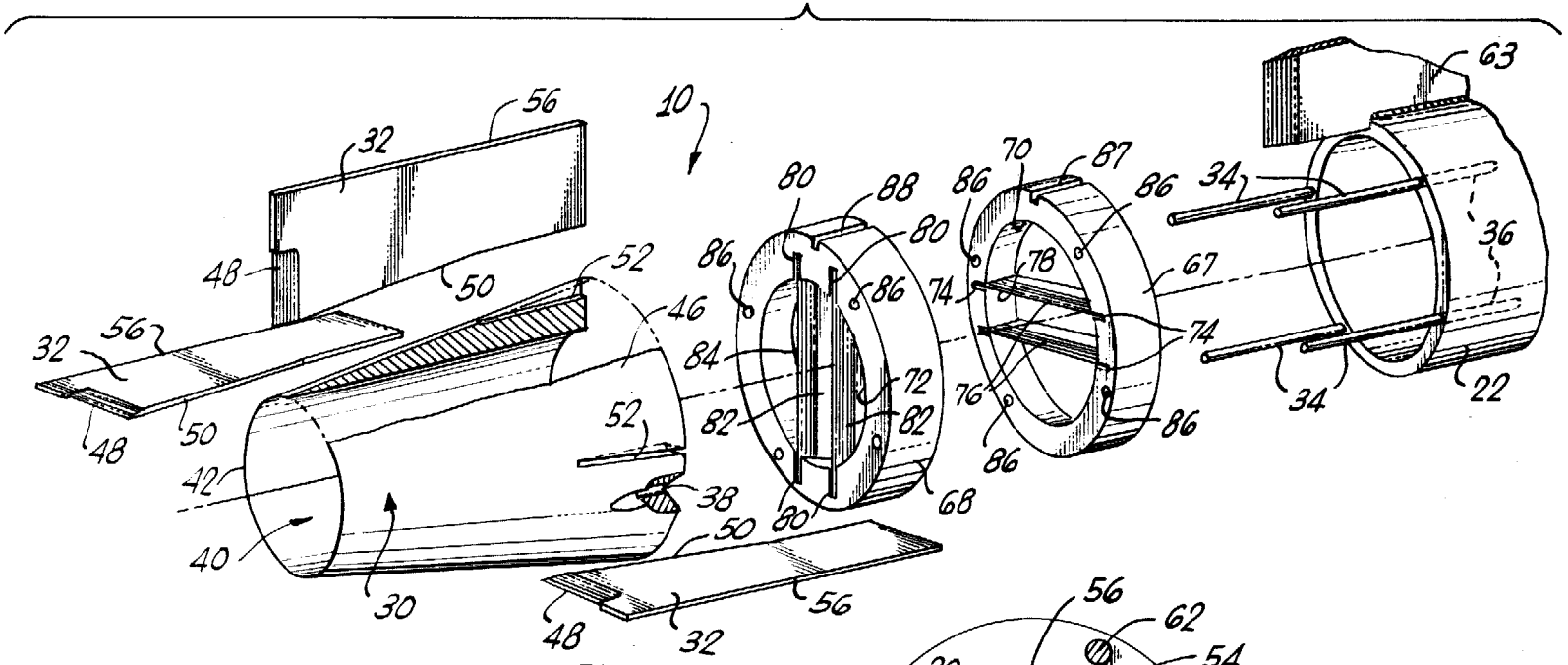
FIG. 4 is an enlarged, exploded, perspective view illustrating assembly of components of the cutting assembly.
FIG. 5 is a vertical section taken generally along the line 5—5 of FIG. 2.

As shown in FIGS. 2, 4 and 5, each strip knife 32 has its radially inner edge 50 shaped for mating engagement with the cone-shaped exterior 46 of the core knife 30 and for reception within a relatively short axially extending slot 52 formed in the core knife exterior near its downstream end. More specifically, the upstream portion of the inner knife edge 50 has a tapered shape for mating contact with the core knife exterior 46, while the downstream portion of the knife edge 50 extends parallel with the core knife axis for seated reception within the slot 52. This slot has a depth and extends forwardly from the downstream end of the core knife for a distance chosen for secure anchoring of the strip knife 32 without undue structural weakening of the core knife. While four of these slots 52 for receiving four of the strip knives 32 are shown arranged at 90-degree increments, any number of the slots 52 and knives 32 can be used.

The radially outer edges 56 of the strip knives 32 are received within slots 54 formed in the exterior housing 28. This exterior housing 28 comprises an enlarged cylinder positioned concentrically about the core knife 30 and connected between the pressure conduit 16 and the outer strip discharge conduit 24. This housing 28 defines an inner diameter surface 53 which tapers radially outwardly toward its downstream end with an angle of taper chosen to correspond with the cone-shaped exterior 46 of the core knife 30. The slots 54 extend longitudinally within this inner diameter surface 53 at appropriate angular intervals for receiving the radially outer edges 56 of the core knives 32. The number and angular location of these latter slots 54 are, therefore, chosen to correspond with the number and angular locations of the slots 52 in the core knife.

The assembly housing 28 conveniently includes a pair of enlarged flanges 58 and 60 secured as by welding to its opposite ends. These flanges 58 and 60 have suitable bolt holes formed therethrough for reception of mounting bolts 62 for securing the housing 28 between a flange 64 at the downstream end of the pressure conduit 16, and a flange 66 at the upstream end of the outer strip discharge conduit 24. If desired, the housing 28 can be split into, for example, semi-cylindrical halves, or any other combination of pieces, to facilitate rapid changing or sharpening of the strip knives 32 and the core knife 30.

The strip knives 32 are thus structurally supported between the core knife 30 and the assembly housing 28, with their cutting edges 48 positioned generally in the same radial plane as the core knife cutting edge 42. Importantly, the radial spacing between the core knife 30 and the inner diameter surface 53 of the housing 28 is substantially constant throughout the axial length of the strip knives 32 in order to prevent substantial reduction in the hydraulic driving force applied to the outer strips 14 as they are being cut. Once again, this constant cross-sectional spacing or flow area insures optimum use of the kinetic energy applied to each potato 11 by the hydraulic fluid. For the outer strips 14, however, the prevention of any substantial pressure drop during cutting avoids substantial turbulence of the hydraulic fluid which would otherwise tend to fracture and/or shatter the relatively fragile strips, and thereby prevent their use as a separate shaped commerical product.

In operation, the potatoes are propelled one at a time by the hydraulic fluid into cutting engagement with the cutting edge 42 of the core knife 30 and with the cutting edges 48 of the strip knives 32. These various cutting elements simultaneously divide each potato 11 into the cylindrical central core 12 and the plurality of longitudinal outer strips 14. The size of the core 12 is, of course, defined by the diameter of the core knife cutting edge 42. Each outer strip 14 has an arcuate inner surface which is also defined by the size of the core knife cutting edge, as well as a pair of radial side surfaces separated by an arcuate width according to the angular spacing between adjacent strip knives 32. The radially outer surface of each strip 14 is uncut by the cutting assembly, preferably to include the natural potato peel.

The core knife 30 and the strip knives 32 provide a structurally rigid and optimally compact hydraulic cutting assembly which eliminates extraneous support devices interfering with flow of the cut potato pieces. This allows both the core 12 and the outer strips 14 to be confined to flow paths of substantially constant cross-sectional area, thereby preventing any relieving of the hydraulic driving force during the cutting process. This is particularly important when it is desired to maintain the shape integrity of the outer strips 14, since they are thus not subjected to breakage as a result of fluid turbulence. The core 12 is discharged to the core discharge conduit 22 and the outer strips 14 are discharged to the outer strip discharge conduit 24, both of which can include gradually expanding cross sections for gradual hydraulic pressure reduction without product breakage. If desired, as shown in FIGS. 2 and 4, a longitudinal vane 63 can be aligned with one of the strip knives 14 and connected between the two conduits 22 and 24 to secure the two conduits rigidly with respect to each other.

The cutting assembly 10 of this invention is readily adapted to include additional cutting elements for dividing the central core 12 into a plurality of French fry strips. More specifically, as viewed in FIGS. 2–4, a pair of knife collars 67 and 68 are interposed in series between the core discharge conduit 22 and the core knife 30. The two collars include central passages 70 and 72 which, in combination, define a gradually expanding cross-sectional flow path between the core knife passage 40 and the core discharge conduit 22.

The collar 67 includes aligned pairs of slots 74 for supporting a plurality of parallel cutting knives 76 each extending across the passage 70 with a cutting edge 78 presented in an upstream direction. Similarly, the other collar 68 includes aligned pairs of slots 80 for supporting another plurality of parallel cutting knives 82 to extend across its passage 72 with cutting edges 84 presented in an upstream direction.

The two collars 67 and 68 also include relatively small axial holes 86 about their peripheries for appropriate reception of the positioning pins 34, whereby the collars are easily mounted between the core knife 30 and the discharge tube 22. Moreover, the collars include external axial slots 87 and 88 for respective reception of a forwardly projecting end of the conduit support vane 63. As illustrated, the collars are positioned with their respective sets of cutting knives 76 and 82 in perpendicular relation to each other to define a criss-cross array of cutting knives which divide the core 12 into French fry strips. The gradually expanding flow path provided by the collars compensates for the presence of the cutting knives 76 and 82 along the flow path whereby the French fry strips are cut and separated from each other without cellular damage to the potato. If desired, when unpeeled potatoes are used, these French fry strips will include small portions of potato peel at their opposite ends. Alternately, potatoes having their opposite ends scraped free of peel can be used whereby the French fry strips will not include peel but the outer arcuate strips 14 will include the exterior surface with the natural potato peel.

A variety of modifications and improvements to the cutting assembly of this invention are believed to be apparent to one skilled in the art. Accordingly, no limitation upon the invention described herein is intended, except as set forth in the appended claims.

What is claimed is:

1. A cutting assembly for dividing a product into a generally cylindrical central core and a plurality of longitudinally extending outer strips each having a generally arcuate cross section, comprising:

an exterior housing having a central longitudinal passage formed therein;

a generally cylindrical hollow core knife having a generally circular cutting edge at one axial end thereof and being sized for reception into said housing generally along the axis of said passage, said core knife having a longitudinally extending central passage formed therein and an outer diameter surface having a generally cone-shaped configuration progressively expanding radially outwardly from said core knife cutting edge to the opposite axial end thereof, and wherein said central longitudinal passage in said housing has an inner diameter surface progressively expanding radially outwardly generally in parallel with said outer diameter surface of said core knife;

said core knife having a plurality of radially outwardly open and longitudinally extending slots formed in at least a portion of the outer diameter surface thereof, axially opposite said core knife cutting edge and wherein said housing has a corresponding plurality of radially inwardly open and longitudinally extending slots formed in the inner diameter surface thereof in general alignment with said core knife slots; and a plurality of strip knives each extending radially between said housing and said core knife for structurally supporting said core knife with respect to said housing, each of said strip knives being removably receivable within one of said core knife slots and an aligned one of said housing slots, said strip knives each having a radially inner edge shaped for mating reception into one of said core knife slots and for mating engagement with the remaining length of said core knife outer diameter surface and including a cutting edge presented in the same direction as said core knife cutting edge, said core knife and said strip knives being operable to divide the product into the core for passage through said core knife and said plurality of outer strips for passage between said core knife and said housing.

2. The cutting assembly of claim 1 wherein said core knife has a central longitudinal passage formed therethrough of substantially constant cross section.

3. The cutting assembly of claim 1 wherein said strip knives and said core knife cooperate with said housing to define a plurality of longitudinal passages between said core knife and said housing, each of said plurality of longitudinal passages having a substantially constant cross section throughout the length thereof.

4. The cutting assembly of claim 3 wherein each of said strip knives is generally rectangular in shape having a length generally corresponding with the length of said core knife and a width generally corresponding to the radial dimension between said core knife and said housing, said strip knife cutting edge being formed at one axial end thereof.

5. The cutting assembly of claim 4 wherein said cutting edges of said strip knives are disposed generally in the same radial plane as said core knife cutting edge.

6. The cutting assembly of claim 1 wherein the product is a potato.

7. The cutting assembly of claim 1 including means coupled to said core knife at its axial end opposite said core knife cutting edge for dividing said core into a plurality of relatively small longitudinal strips.

8. For use in a system including an hydraulic pressure conduit, means for propelling potatoes one at a time through the pressure conduit, an inner discharge conduit and a concentric outer discharge conduit both aligned generally coaxially with the pressure conduit, a cutting assembly for dividing each potato into a generally cylindrical central core for passage to the inner conduit and a plurality of longitudinally extending outer strips each having a generally arcuate cross section for passage to the outer conduit, comprising:

a generally cylindrical hollow core knife mounted at the upstream end of the inner conduit generally coaxially therewith and projecting axially therefrom and having a generally circular cutting edge presented in an upstream direction, said core knife having a generally cone-shaped outer diameter surface expanding radially from its upstream to its downstream end;

an exterior housing mounted generally coaxially between the downstream end of the pressure conduit and the upstream end of the outer conduit, said housing being positioned generally concentrically about said core knife and including an inner diameter surface expanding radially from its upstream to its downstream end and which cooperates with said core knife outer diameter surface to define a longitudinal passage between said housing and said core knife of substantially constant cross section throughout the axial length thereof; and a plurality of strip knives each extending radially between said core knife and said housing and anchored therebetween, each of said strip knives including a cutting edge presented generally in an upstream direction, said core knife and said strip knives being operable to divide the product into the core for passage through said core knife into said inner conduit and said outer strips for passage between said core knife and said housing for passage into said outer conduit.

9. The cutting assembly of claim 8 wherein said core knife has a central longitudinal passage formed therethrough of substantially constant cross section.

10. The cutting assembly of claim 8 wherein said core knife has a plurality of radially outwardly open and longitudinally extending slots formed in the outer diameter surface thereof, and wherein said housing has a corresponding plurality of radially inwardly open and longitudinally extending slots formed in the inner diameter surface thereof in alignment with said core knife slots, said strip knives each being removably receivable within one of said core knife slots and an aligned one of said housing slots.

11. The cutting assembly of claim 8 including means coupled to said core knife at its axial end opposite said core knife cutting edge for dividing said core into a plurality of relatively small longitudinal strips.

12. The cutting assembly of claim 11 wherein said means for dividing said core into a plurality of relatively small strips comprises a pair of knife collars axially interposed between said core knife and said inner conduit, each of said knife collars supporting a plurality of parallel cutting knives oriented generally perpendicular to the cutting knives of the other knife collar to define a crisscross array of cutting knives.

13. For use in a system including an hydraulic pressure conduit, means for propelling a product one at a time through said pressure conduit along with a propelling hydraulic fluid, an inner discharge conduit, and an outer discharge conduit positioned generally concentrically about the inner discharge conduit, a cutting assembly for dividing the product into a generally cylindrical central core for discharge to said inner conduit and a plurality of longitudinally extending outer strips each having a generally arcuate cross section for discharge to said outer conduit, comprising:

an exterior housing connected between said pressure conduit and said outer conduit and having a central longitudinal passage formed therein;

a generally cylindrical hollow core knife mounted on said inner conduit and projecting axially toward said pressure conduit within said housing passage, said core knife having a generally circular cutting edge formed at its axial end opposite said inner conduit; and a plurality of strip knives each extending radially between said core knife and said housing, each of said strip knives including a cutting edge presented generally in the same direction as said core knife cutting edge, said core knife and said strip knives being operable to divide the product into the core for passage through said core knife into said inner conduit and said outer strips for passage between said core knife and said housing for passage into said outer conduit.

14. The cutting assembly of claim 13 wherein said strip knives and said core knife cooperate with said housing to define a plurality of longitudinal passages between said core knife and said housing, each of said plurality of longitudinal passages having a substantially constant cross section throughout the length thereof.

15. The cutting assembly of claim 14 wherein said core knife has a central longitudinal passage formed therethrough of substantially constant cross section.

16. The cutting assembly of claim 13 wherein said cutting edges of said strip knives are disposed generally in the same radial plane as said core knife cutting edge.

17. The cutting assembly of claim 13 wherein said core knife has a plurality of radially outwardly open and longitudinally extending slots formed in the outer diameter surface thereof, and wherein said housing has a corresponding plurality of radially inwardly open and longitudinally extending slots formed in the inner diameter surface thereof in alignment with said core knife slots, said strip knives each being removably receivable within one of said core knife slots and an aligned one of said housing slots.

18. The cutting assembly of claim 17 wherein said core knife has a longitudinally extending central passage formed therein, and an outer diameter surface having a generally cone-shaped configuration progressively expanding radially outwardly from said core knife cutting edge to the opposite axial end thereof, and wherein said central longitudinal passage in said housing has an inner diameter surface progressively expanding radially outwardly generally in parallel with said outer diameter surface of said core knife.

19. The cutting assembly of claim 18 wherein each of said core knife slots is formed over at least a portion of said outer diameter surface axially opposite said core knife cutting edge, and wherein each of said strip knives has a radially inner edge shaped for mating reception into one of said core knife slots and for mating engagement with the remaining length of said core knife outer diameter.

20. The cutting assembly of claim 13 including means coupled to said core knife at its axial end opposite said core knife cutting edge for dividing said core into a plurality of relatively small longitudinal strips.

21. The cutting assembly of claim 20 wherein said means for dividing said core into a plurality of relatively small strips comprises a pair of knife collars axially interposed between said core knife and said inner conduit, each of said knife collars supporting a plurality of parallel cutting knives oriented generally perpendicular to the cutting knives of the other knife collar to define a crisscross array of cutting knives.

22. The cutting assembly of claim 13 wherein said core knife is mounted coaxially with said inner conduit at the upstream end of said inner conduit, and wherein said housing is mounted coaxially between the pressure conduit and said outer conduit.

* * * * *